US007421827B1

(12) United States Patent
Konstantinidis

(10) Patent No.: US 7,421,827 B1
(45) Date of Patent: Sep. 9, 2008

(54) CELLULAR STIRRUPS AND TIES FOR STRUCTURAL MEMBERS

(76) Inventor: Apostolos Konstantinidis, Alektoros 7, Athens 11632 (GR)

( * ) Notice: Subject to any disclaimer, the term of this patent is extended or adjusted under 35 U.S.C. 154(b) by 1212 days.

(21) Appl. No.: 09/530,745

(22) PCT Filed: Nov. 4, 1998

(86) PCT No.: PCT/GR98/00029

§ 371 (c)(1),
(2), (4) Date: May 4, 2000

(87) PCT Pub. No.: WO99/23325

PCT Pub. Date: May 14, 1999

(30) Foreign Application Priority Data

Nov. 5, 1997 (GR) ..... 970100422

(51) Int. Cl.
*E04C 3/30* (2006.01)

(52) U.S. Cl. ..... 52/740.1; 52/252; 52/649.3

(58) Field of Classification Search ..... 52/740.1, 52/127.3, 252, 649.2, 649.3
See application file for complete search history.

(56) References Cited

U.S. PATENT DOCUMENTS

| | | | | |
|---|---|---|---|---|
| 411,360 | A * | 9/1889 | Stempel | 52/169 |
| 3,874,062 | A | 4/1975 | Muto et al. | |
| 4,472,331 | A * | 9/1984 | Kida | 264/31 |
| 5,181,359 | A * | 1/1993 | Chana | 52/253 |
| 5,367,854 | A * | 11/1994 | Kim | 52/745.13 |
| 5,542,785 | A * | 8/1996 | Cloud | 405/239 |
| 6,293,071 | B1 * | 9/2001 | Konstantinidis | 52/659 |

FOREIGN PATENT DOCUMENTS

| | | |
|---|---|---|
| FR | 532620 | 2/1922 |
| WO | 9322516 | 11/1993 |

OTHER PUBLICATIONS

Dekker; Kemp, "Factors influecing the strength of continous composite beams in negative bending" article, 1995, Journal of Constructional Steel Research v 34 n 2-3, p. 161-185.*
Dekker; Kemp, "Factors influecing the strength of continous composite beams in negative bending" article, 1995, Journal of Contructional Steel Research v 34 n 2-3, p. 161-185.*

* cited by examiner

*Primary Examiner*—Richard Chilcot, Jr.
*Assistant Examiner*—Chi Q Nguyen
(74) *Attorney, Agent, or Firm*—The Webb Law Firm

(57) ABSTRACT

The present invention refers to stirrups and ties for structural members. Such stirrups and ties are used in all the structural members like columns, beams, slabs, footings, piles, chainages, lintels etc. The invention refers also to a method of reinforcement of structural members and to the structural members themselves. According to the invention the stirrup or tie consists of a load-bearing element for the fixing of the longitudinal rebars and for the undertaking of the tensile forces which develop during the loading of the structural members. The load bearing element consists of at least one cell of closed shape so that the flow of the tensile stresses developed in the cross section is closed and the stresses are not diffused to the concrete. The load bearing element of the stirrup or tie in accordance to the invention has a continuous cross section and thus there are no free ends as in the known stirrups. In this way anchoring of the stirrups or ties is completely avoided. The closed cellular shape has no discontinuation and may be simple, for example, rectangular, circular, T-shaped, I-shaped, etc. or complete, for example, square with inscribed rectangular, circular with inscribed per square etc.

19 Claims, 22 Drawing Sheets

Figur 4

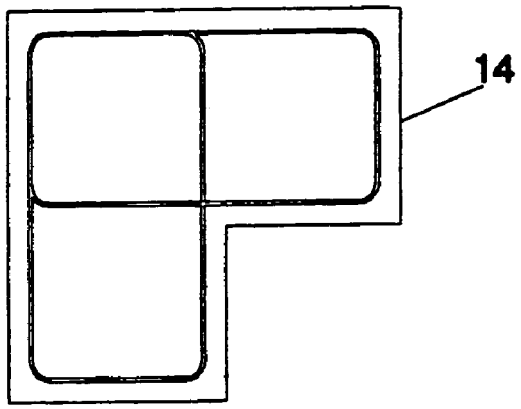
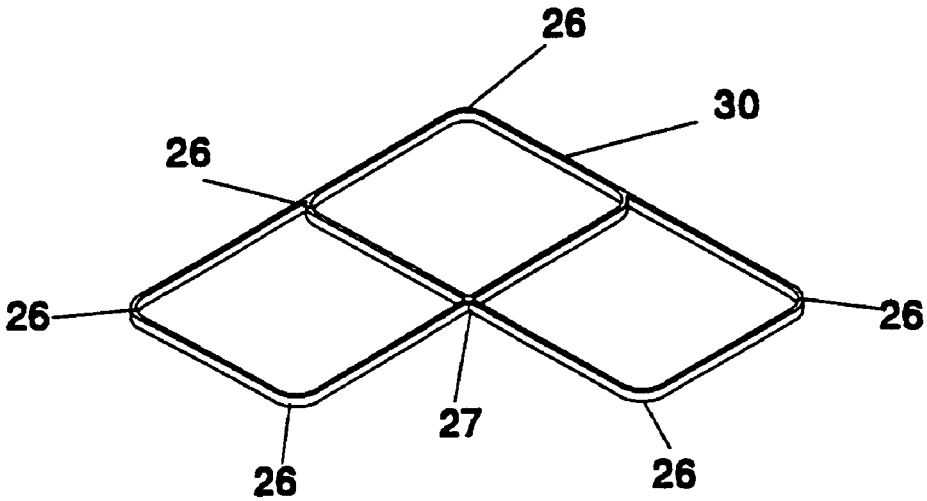
Figure 7

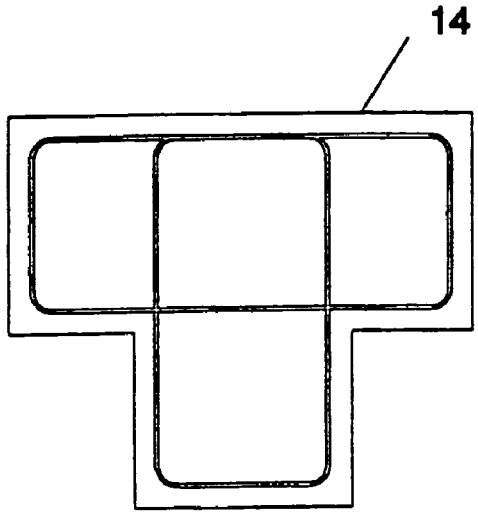
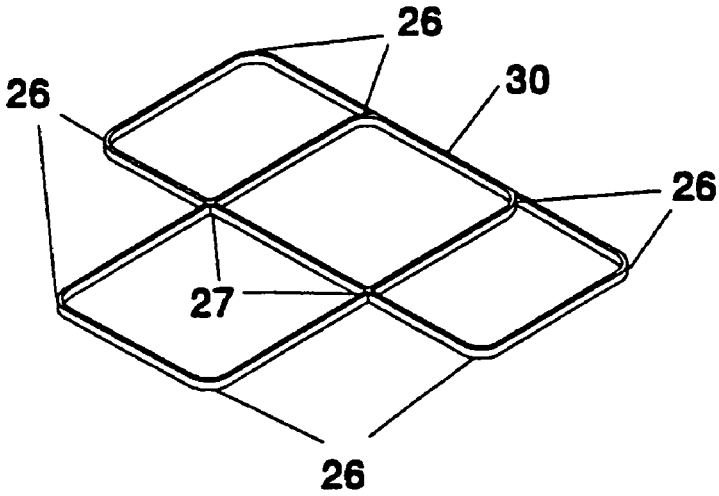
Figure 8

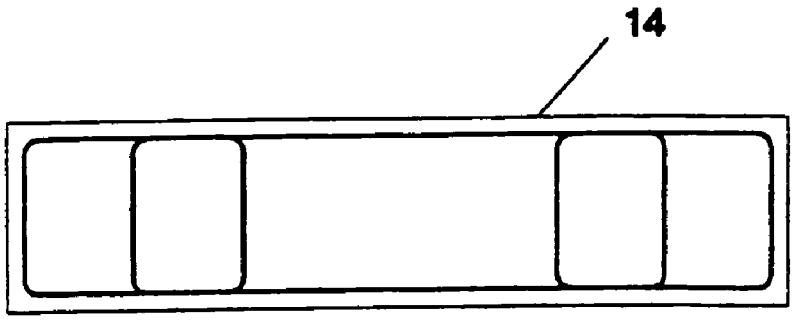
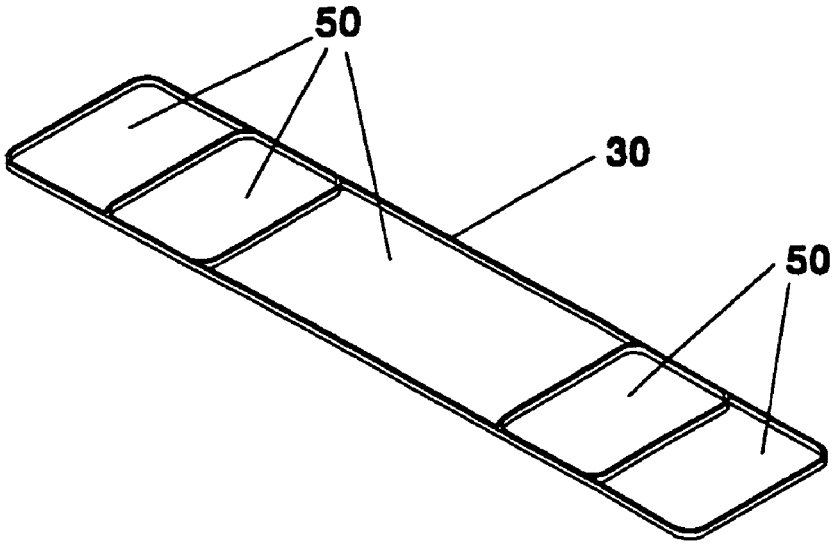
Figure 11

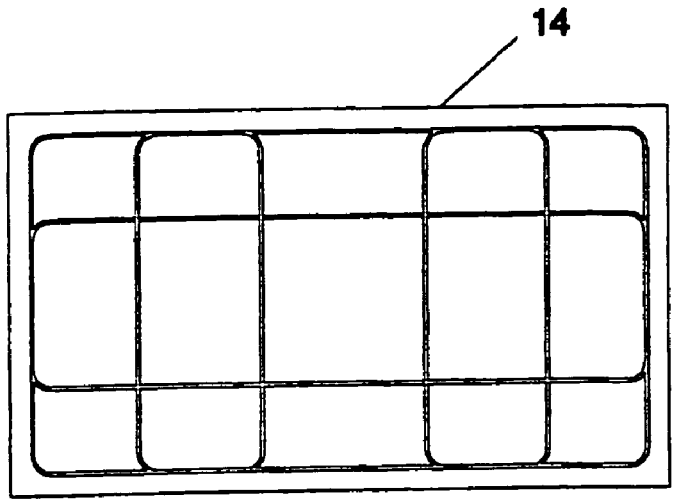
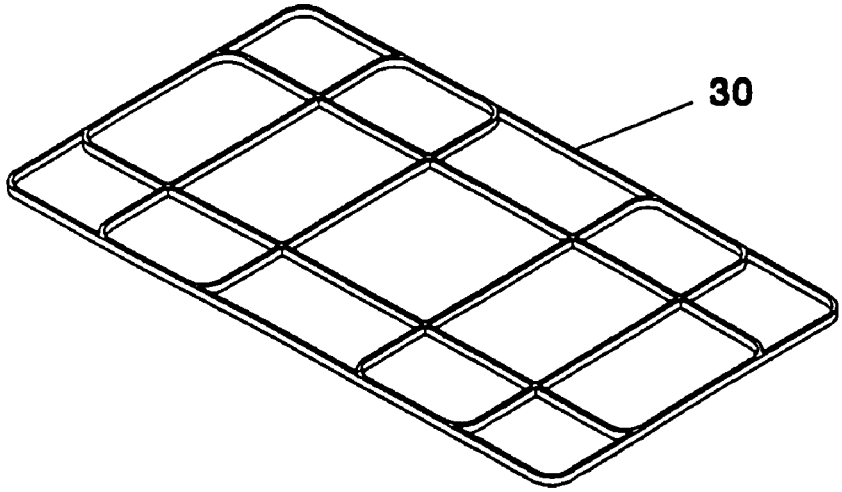
Figure 12

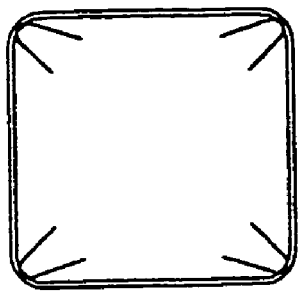
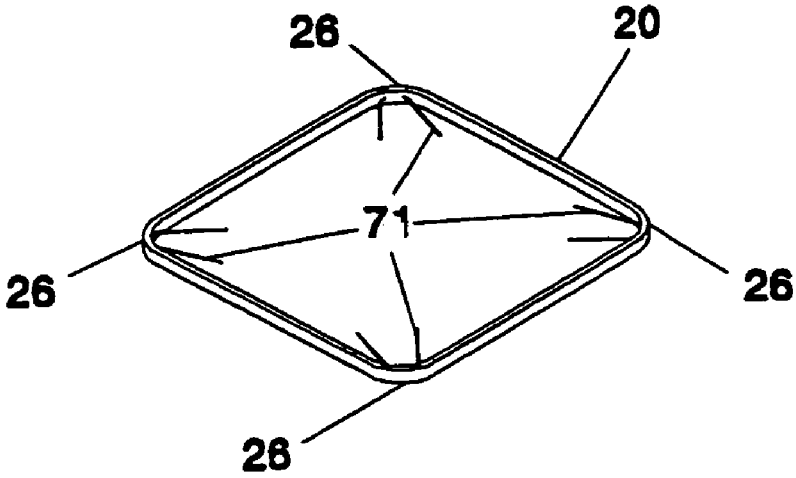
Figure 16

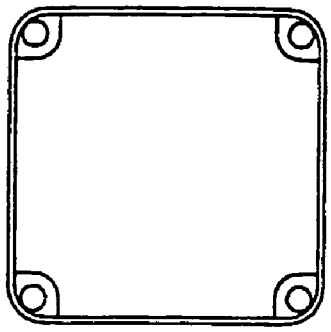
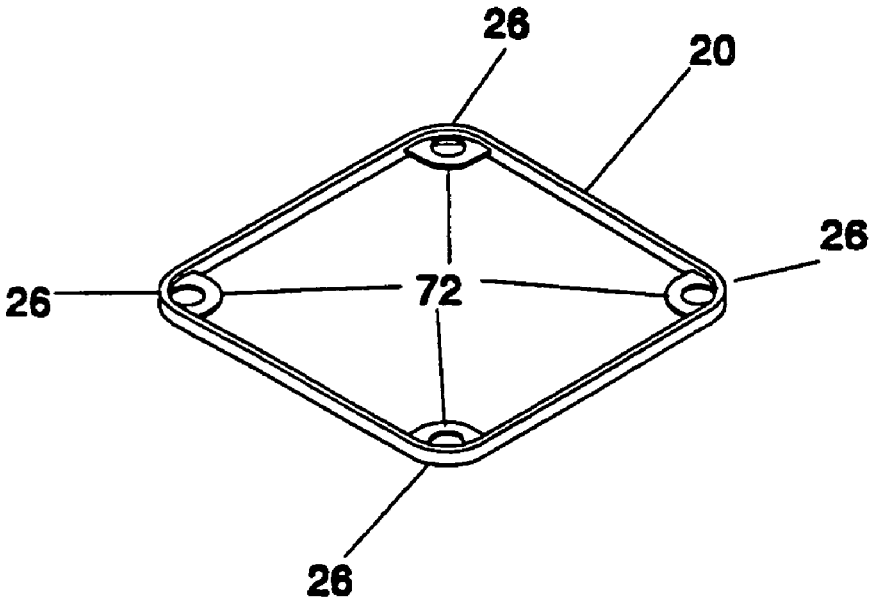
Figure 17

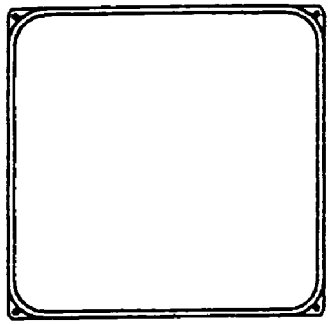
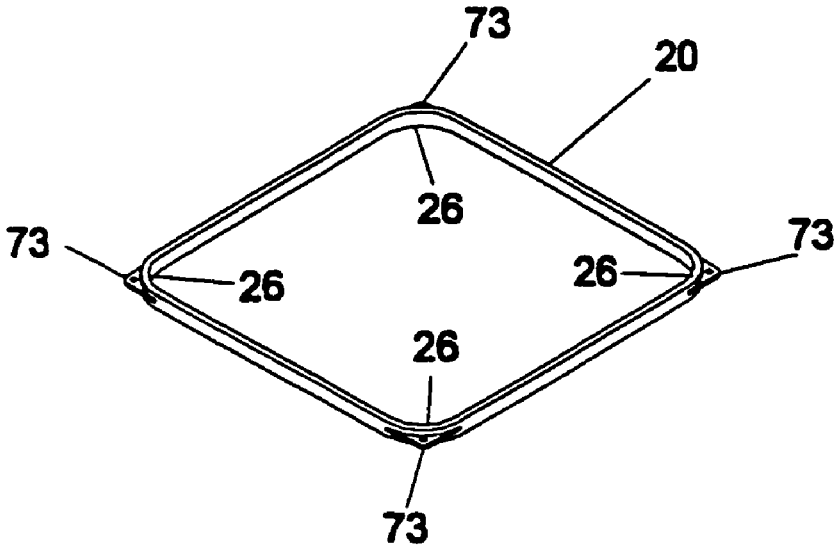
Figure 18

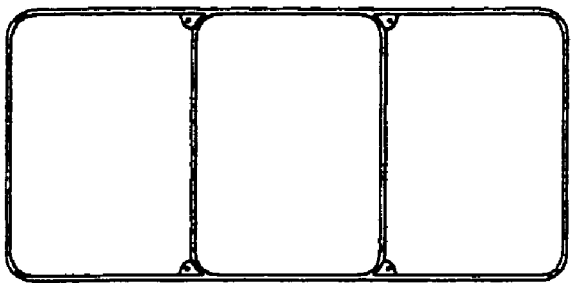
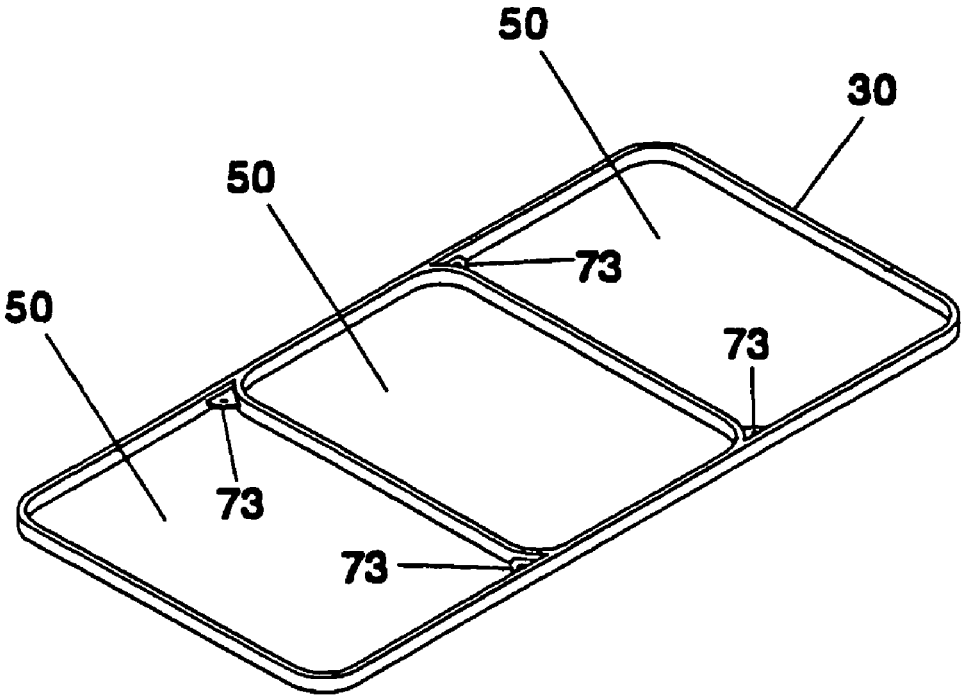
Figure 19

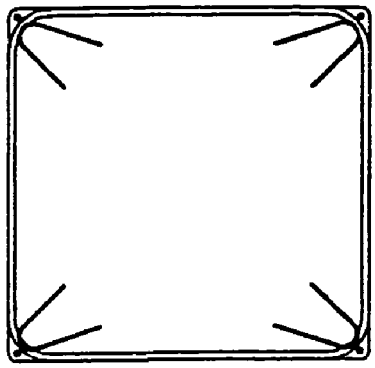
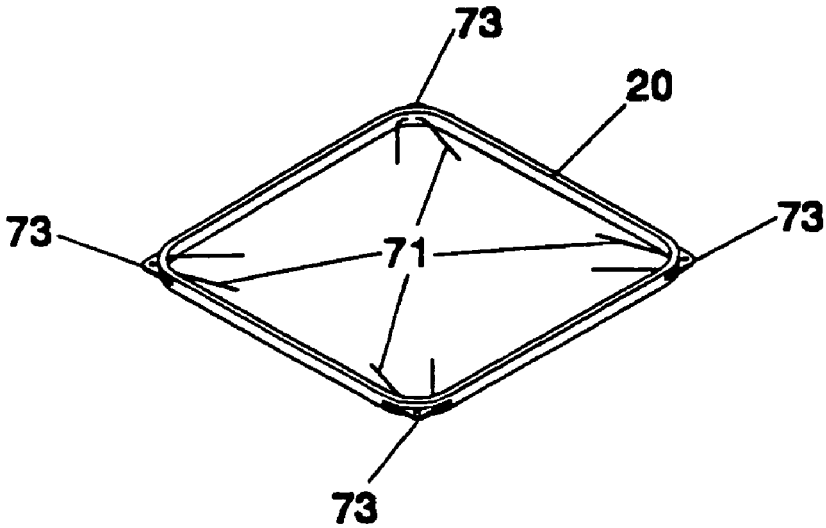
Figure 20

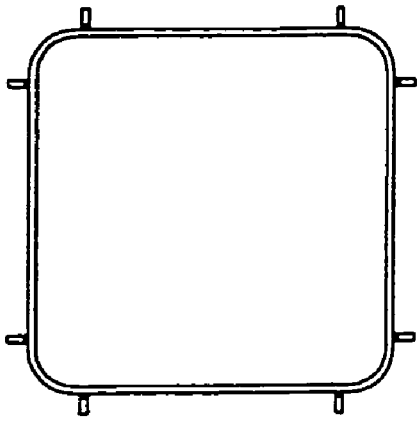
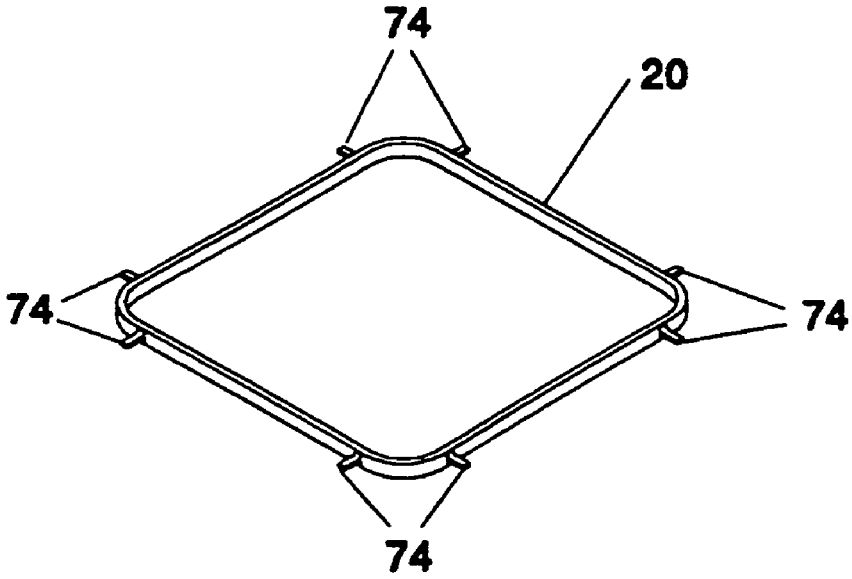
Figure 21

CELLULAR STIRRUPS AND TIES FOR STRUCTURAL MEMBERS

BACKGROUND OF THE INVENTION

1. Field of the Invention

The present invention refers to stirrups and ties for structural members. Such stirrups and ties are used in all the structural members like columns, beams, slabs, footings, piles, chainages, lintels e.t.c. The invention refers also to a method of reinforcement of structural members and to the structural members themselves.

2. Description of the Current Art

It is known that stirrups and ties constitute one of the most critical factors of strength of concrete structural members because they undertake the tensile forces, which cannot be carried by the concrete itself. These tensile forces are due to the shear forces, which load the structural member, and/or to the internal pressure which is created when the structural member is subjected to strong compressive loads.

The usual stirrups and ties of the concrete structural members consist of steel bars of grade 220 MPa up to grade 500 MPa with circular cross-section and diameter from 4 mm up to 14 mm. These stirrups and ties are placed along the structural members at distances from 4 cm up to 35 cm. The longitudinal rebars of the structural members are tied or welded at the corners or at the perimeter of the stirrups and ties. The cross-sections of the structural members take values from the range 15 cm up to 2 m. At the two ends of the bar of every stirrup or tie there are hooks, with length about 10 cm, for the anchorage of the stirrup or tie, which means the transfer of the tensile forces from the steel bar to the concrete.

The main factor of the reliability of the usual stirrups and ties is anchorage. Nowadays there are two types of closed stirrups and ties, which are distinguished by the way of the anchorage of their ends:

The usual stirrups and ties are of simple shape like orthogonal (FIG. 1) or of complex shape (FIG. 1A). The steel bar 11, which is loaded by tension, ends in two hooks 12 which insure the anchorage of the stirrup or tie. The anchorage of the stirrup or tie is improved when the hook of its one end is fastened to the hook of its other end, as it is can been seen for example in the welded connection of FIG. 1. The anchorage of such a stirrup or tie is achieved with hooks at an angle of 90° or more efficiently with hooks at an angle of 135°. The disadvantages of these stirrups and ties are: a) the mechanical anchorage point is very delicate and is a point of probable defective construction, b) the anchorage mechanism confines the use of high-grade steel, i.e. of strength 1200 MPa, in this type of stirrups and ties and the result is that much steel is required with great weight and high cost, c) and there is a need for relatively careful fastening of the two hooks with the longitudinal rebars 10.

Document WO 93/22516 shows grids 40 and grids 60 for the reinforcement of concrete columns and girders respectively. The grids 40 and 60 are formed by longitudinal and transverse members 44, 42 and 64, 62 respectively, which are welded at their intersections leaving a projecting end beyond the weld, at the end of each longitudinal or transverse member. These projecting ends are used to attach the plane grids in order to form the 3-D structure shown in FIG. 4 (see also FIG. 4a).

Document GB 1,086,857 shows a tie (FIG. 2, 5, 7) formed by members, which according to page 1, lines 54 to 57, are "arranged in their desired configuration with their adjacent ends overlapping and secured together by welding leaving projecting ends beyond the weld".

Document U.S. Pat. No. 4,472,331 discloses a method for building a reinforced concrete structure. When applied for the construction of columns the method employs column reinforcement frames A (FIG. 2) and column shearing reinforcement bands C (FIG. 8). Similarly when applied for the construction of beams the method employs beam reinforcement frames B (FIG. 5) and beam shearing reinforcement bands C (FIG. 9). The problem addressed by the invention of the document is the precise arrangement of the main reinforcement bars of columns and beams (see column 1, lines 25 and 26), and the function of the elements A and B is to receive and position in the bar insertion holes 1 and 1' the reinforcement bars. Shearing reinforcement of the columns and beams is effected by the elements C and D, which correspond to the stirrups or ties of the invention of the present application. In accordance with D2 the column shearing reinforcement band C and the beam shearing reinforcement band D are " . . . formed by bending a steel strip into a rectangular frame shape . . . ". FIGS. 17 and 18 of U.S. Pat. No. 4,472,331 shows the overlapping ends of C and D.

Document FR 532.620 discloses reinforcement for beams or columns comprising ties 8 encircling the longitudinal rebars. The document discloses that the ties 8 have an annular shape ("forme d'anneaux", page 2, line 40) and does not give any information on their ends other that on page 2, lines 42 to 44. In accordance thereto the ties form a "double crochets", which is shown in the cross-section presented in FIG. 5. FR 532.620 discloses a particular reinforcement that includes ties of FIGS. 4 and 6. These are elongated ties that may receive two parallel main reinforcement bars.

Further spiral stirrups of simple or complex shape are shown in FIG. 2. These stirrups and ties consist of a steel bar 13, whose unwinding in space creates a stirrup cage with no discontinuation. Their two ends 15 achieve the anchorage of such stirrups and ties in concrete. These stirrups and ties, compared with the usual stirrups and ties, improve the anchorage and permit the use of high grade steel but they have two major disadvantages: a) unstable anchorage of the first and the last helix, b) and excessive weight which makes the use of the spirals difficult during the reinforcement of the structural member.

The object of the invention is to propose stirrups and ties that do not have the disadvantages of the known stirrups and ties. An object of the invention is to develop stirrups and ties that do not have the known problems of anchorage of the usual stirrups and ties. Further objects of the invention is a) the development of a method for the placing of the whole reinforcement in concrete with no anchorage problems, and b) the provision of structural members with high ductility and ability to withstand high seismic loads.

SUMMARY OF THE INVENTION

According to the present invention, the stirrup or tie of a concrete structural member consists of a load bearing element for the fixing of the longitudinal rebars and for the undertaking of the tensile forces which develop during the loading of the structural member. The bearing element consists of at least one cell of closed shape so that the flow of the tensile stresses developed in the cross-section is closed and it is not diffused to the concrete. The load bearing element of the stirrup or tie in accordance to the invention has a continuous cross-section and thus there are no free ends as the stirrups of documents WO 93/22516 and GB 1 086 857. In this way anchoring of the stirrups or ties is completely avoided. The closed cellular shape has no discontinuation and may be simple, i.e. rectangular, circular, T-shaped, I-shaped, e.t.c or complex i.e. square with inscribed rectangles, circular with inscribed square e.t.c.

The closed shape of the stirrups and ties of the invention gives them uniform behaviour with no hot spots, i.e. with any points of stress concentration. Such weak points are present in stirrups or ties with discontinuation or abrupt changes in their shape. Thus the stirrups or ties of the invention have high ductility and they are able to withstand seismic loads. Further the high tensile strength along their whole length renders the use of materials with high tensile properties feasible for their production. Such materials can be loaded with shear forces when used to reinforce columns, beams and other concrete structural members and may be tightened around the rebars to increase the compressive strength and further improve the antiseismic behaviour of the structural members.

These stirrups and ties may be used in every structural member, which needs stirrups or ties i.e. in beams, columns, slabs, footings, chainages, lintels e.t.c. They may be used for the reinforcement of concrete and of any physical or artificial concrete's substitute.

The cross-section of the bearing element of the stirrups and ties of the invention may be of any shape, like circular, orthogonal, ellipsoidal e.t.c. The elements may be manufactured of metal materials, i.e. of usual steel or of high-grade steel or of composites and they may be cast or manufactured by other production methods. The material of the cellular stirrups may be rigid and self-bearing as the usual steel or flexible as well. The general properties and the tightening are the same and only the fastening at the right places is different and can be achieved in various ways i.e. with elastic stretching.

The stirrups and ties of the invention offer the following advantages over the known stirrups and ties:

- They have no delicate anchorage point, so that their strength properties are not reduced around its perimeter.
- Since their material has no discontinuation they can be loaded with great forces and they can be made either of material of normal strength as the usual steel, i.e. 400 MPa, with large cross-section, i.e. 2.0 $cm^2$, or of material of high strength, i.e. 3000 MPa, and small cross-section, i.e. 0.30 $cm^2$.
- Due to the fact that material of high strength can be used it results that less weight is needed, i.e. ¼ of the usual steel, and especially if the material, which usually is a composite, is of low specific gravity, i.e. ⅕ of the usual steel, then minimum weight is needed, i.e. 1/20 in comparison with that of the usual steel. This reduction of the material weight has positive influence on the decreasing of the cost.
- Low cost due to the minimum material weight.
- Due to the minimum weight and the lack of hooks, the assembly of the reinforcement, i.e. the stirrups and longitudinal bars, of the structural members is simpler and thus the cost for the wages of the workers significantly lower.
- There is no need to rib, i.e. sculpture, the surface of the stirrups and ties to achieve the roughness, which is necessary for the anchoring.
- As the cellular stirrups may be made of composites the reinforced structural members bear profit from the advantages of the use of composite materials, such as the resistance in oxidation.

Another significant advantage of the cellular stirrups and ties is the expected great acceptance by the technicians since they do not subvert radically the well-known theoretical and practical ways for the placing of the reinforcement but they improve them.

The method of reinforcement of the structural members according to the invention has all the advantages of the cellular stirrups and ties and in addition the following advantages:

- It permits the fast assembly of the reinforcement. The assembly of the reinforcement may be done either in the factory or on site or even in the framework if one of its sides remains open.
- Because of the same functioning of the cellular stirrups with the usual steel stirrups they can be used together for the reinforcement of the structural members while the longitudinal rebars may consist of the same or different material.

The advantages of the structural member in accordance with the invention are the advantages of the cellular stirrups and ties and the advantages of the method of reinforcement. Further the structural members in accordance with the inventions have also the following advantages:

- Unobstructed casting of concrete because of the absence of hooks.
- Exceptional ductility of the structural members, that is the ability for undertaking of strong stresses not only during the functioning of the member in the elastic region but during the functioning of the same member in the plastic region as well. Thus high antiseismic strength of the member is achieved.

The stirrups or ties have characteristics, which offer further advantages, some of which are the following:

- For the creation of complex stirrups, it is possible to combine any simpler stirrup or tie. Thus it is possible to create any complex form.
- An alternative method for the fixing of rebars is the shaping of special places during the manufacturing for the passage and restraining of the rebars.
- For the fixing of the rebars in the cellular stirrups or ties, in particular made of composites, it may be advantageous to incorporate a bipolar wire during the casting at the points of fastening of the rebars. The fixing of the rebars may be achieved alternatively through holes. The bipolar wires for the fastening of the rebars and the holes for the passage of the rebars may coexist in stirrups and ties of every shape.
- Some of the load bearing elements are cast. In this way stirrups and ties of any shape can be manufactured. Further, some of the load bearing elements have solid cross-section.
- Every part of a complex stirrup or tie may be of different size of cross-section and may have different shape of cross-section. The enlargement of the cross-section may be done in both directions either to the width inside the cross-section of the element or to the height upward or downward or simultaneously to the width and height in every direction.
- The stirrups and ties may comprise special holes for the passage of special installation bars. This is particularly advantageous for the case that the reinforcement is prefabricated as a cage. In this case rigid installation bars or flexible wires may be received by these holes.
- Along the bearing element there may be projections to insure the concrete cover of the reinforcement and replace the spacers.

BRIEF DESCRIPTION OF THE DRAWINGS

The invention will be now described by way of example and with reference to the accompanying drawings where like reference numbers represent like elements throughout the drawings in which:

FIG. 7 is a top view and a perspective view of a fifth embodiment of a stirrup according to the present invention;

FIG. 8 is a top view and a perspective view of a sixth embodiment of a stirrup according to the present invention;

FIG. 11 is a top view and a perspective view of a ninth embodiment of a stirrup according to the present invention;

FIG. 12 is a top view and a perspective view of a tenth embodiment of a stirrup according to the present invention;

FIG. 16 is a top view and a perspective view of a fourteenth embodiment of stirrups and ties according to the present invention;

FIG. 17 is a top view and a perspective view of a fifteenth embodiment of stirrups and ties according to the present invention;

FIG. 18 is a top view and a perspective view of a sixteenth embodiment of stirrups and ties according to the present invention;

FIG. 19 is a top view and a perspective view of a seventeenth embodiment of stirrups and ties according to the present invention;

FIG. 20 is a top view and a perspective view of an eighteenth embodiment of stirrups and ties according to the present invention; and FIG. 21 is a top view and a perspective view of a nineteenth embodiment of stirrups according to the present invention.

DESCRIPTION OF THE PREFERRED EMBODIMENTS

Figure 1:
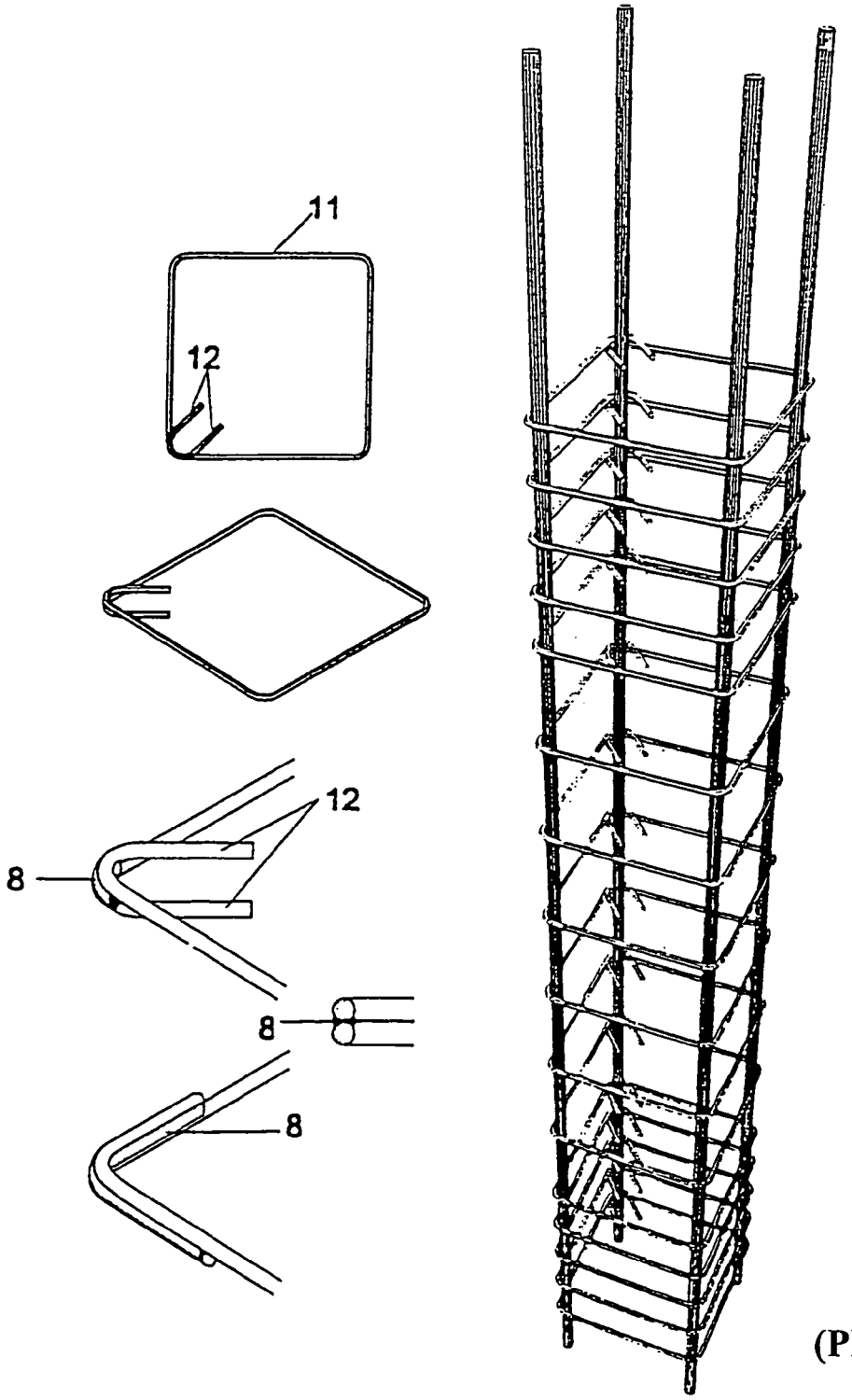
(PRIOR ART) Figure 1
FIG. 1 is a top view and perspective views of prior art spiral stirrups and ties connected to rebars.
Figure 1A:
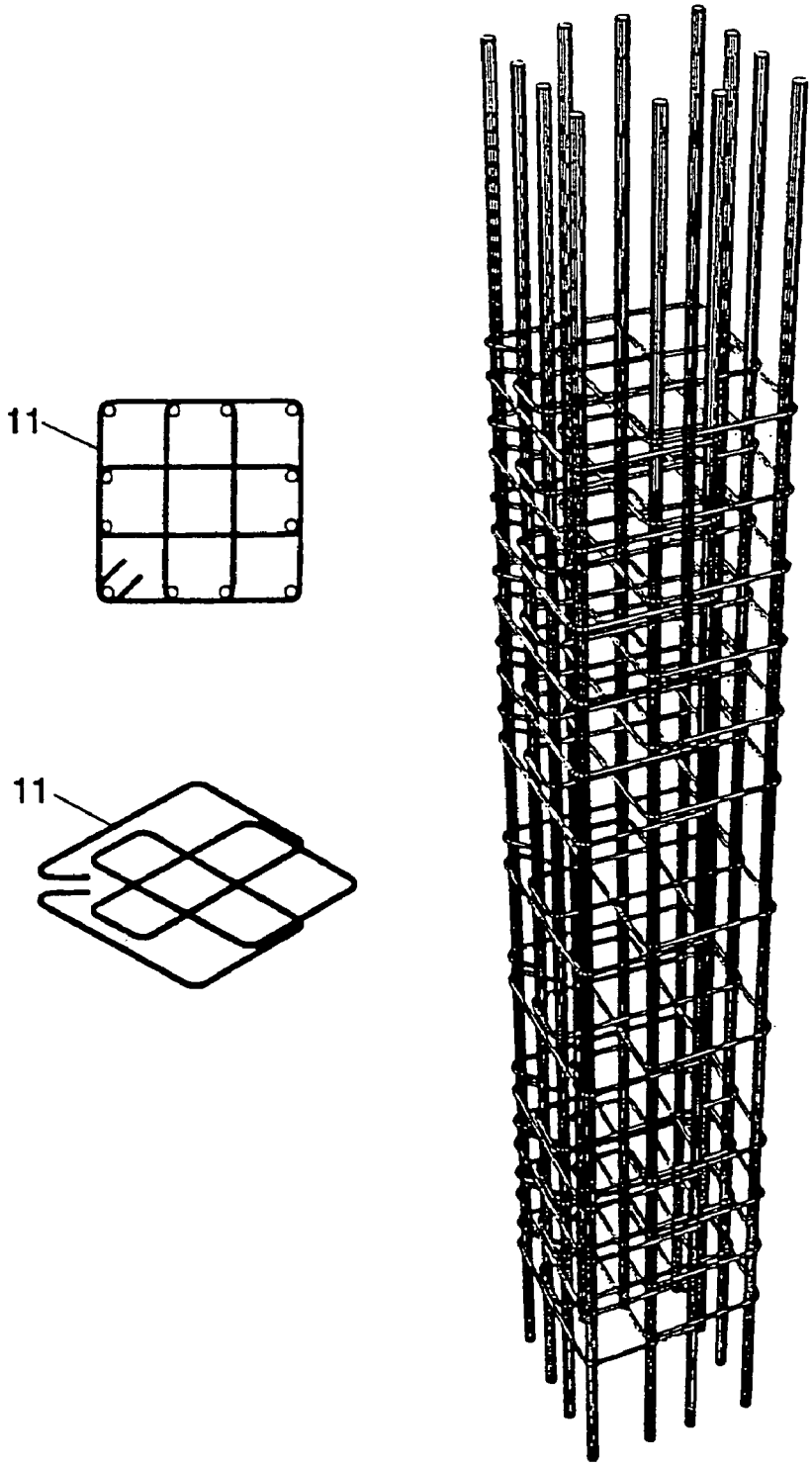
(PRIOR ART) Figure 1A
FIG. 1*a* is a top view and perspective views of prior art spiral stirrups and ties connected to rebars.
Figure 2:
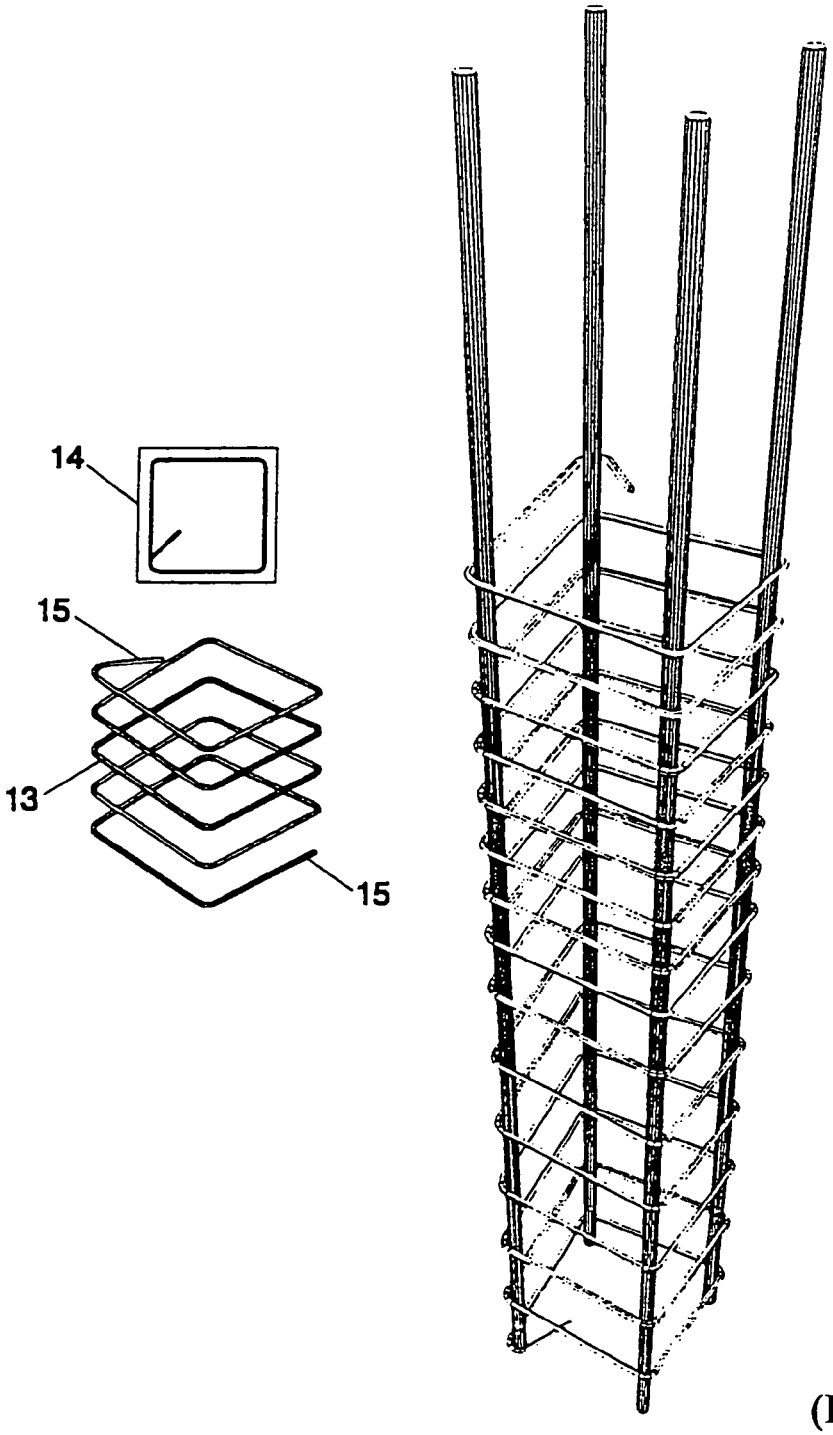
(PRIOR ART) Figure 2
FIG. 2 is a top view and perspective views of prior art spiral stirrups and ties connected to rebars.
Figure 3:
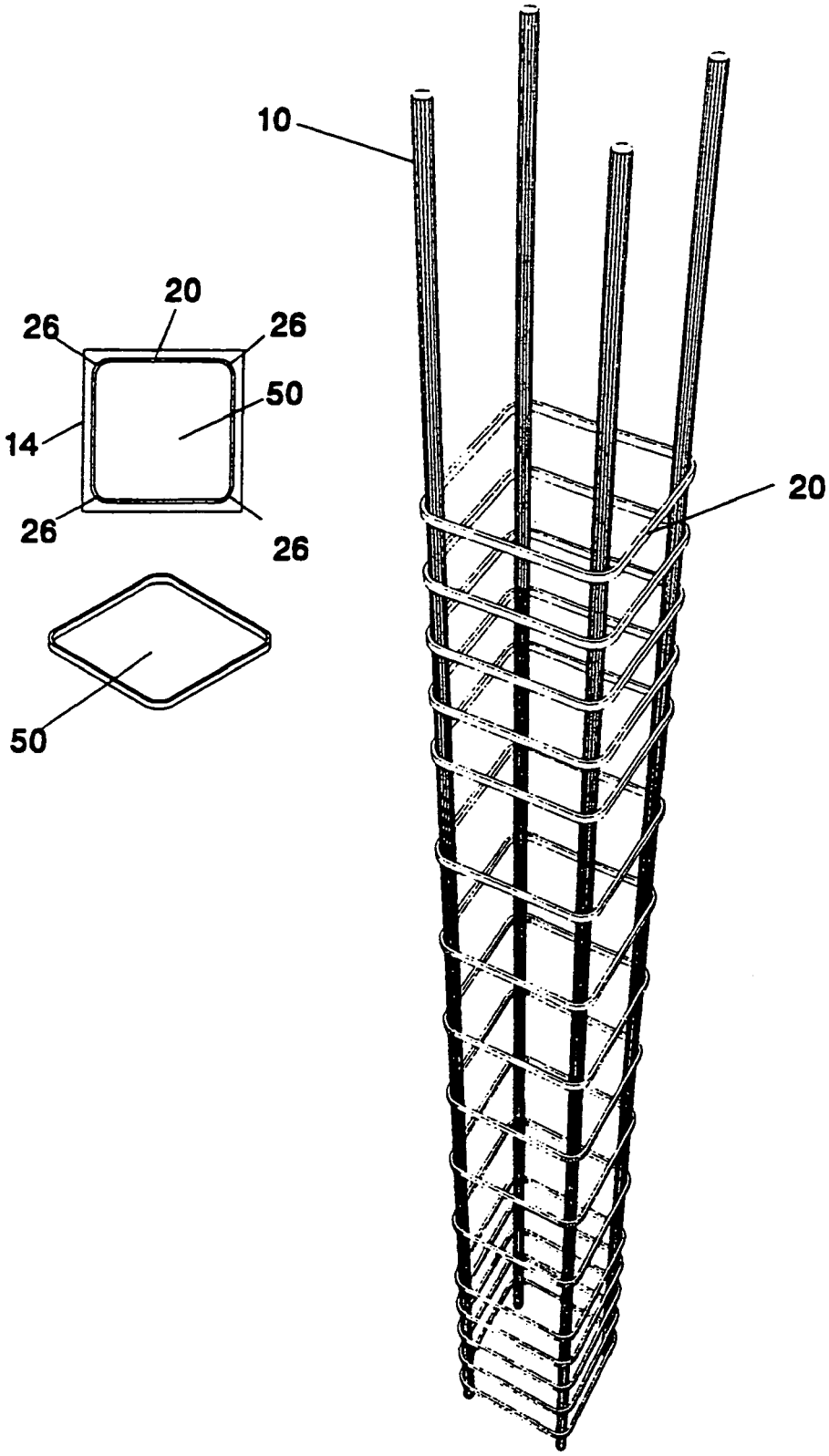
FIG. 3 is a top view and perspective views of a first embodiment of a stirrup according to the present invention having a simple form.

FIG. 3 resents a stirrup within the framework 14. The stirrup consists of a load-bearing element 20 which is a rectangular ring and closed cell 50 having an inner periphery and an outer periphery. At the corners of the ring 50, there is a provision of special places 26 for receiving the rebars 10. These places may be formed like the shape of the perimeter of the rebars 10, so that the rebars are received within the inner periphery of the dosed cell and abut against it.

During the loading of the structural element and the rebars 10, axial tensile forces are created in the cross-section of the bearing element 20. Because of the closed cellular shape of the bearing element, the axial tensile forces are not transferred to the concrete, which surrounds the reinforcement.

The load-bearing element 20 of the stirrup of FIG. 3 has a continuous cross-section and thus there are no free ends. In this way anchoring of the stirrup is completely avoided. The dosed cellular shape has no discontinuation and gives the stirrup uniform behaviour with no hot spots, i.e. with no points of stress concentration. Thus the stirrup has high ductility and it is able to withstand seismic loads. Further the high tensile strength along its whole length renders the use of materials with high tensile properties feasible for its production. Such materials can be loaded with shear forces when used to reinforce columns, beams and other concrete structural members and may be tightened around the rebars to increase the compressive strength and further improve the antiseismic behaviour of the structural members.

Figure 4:
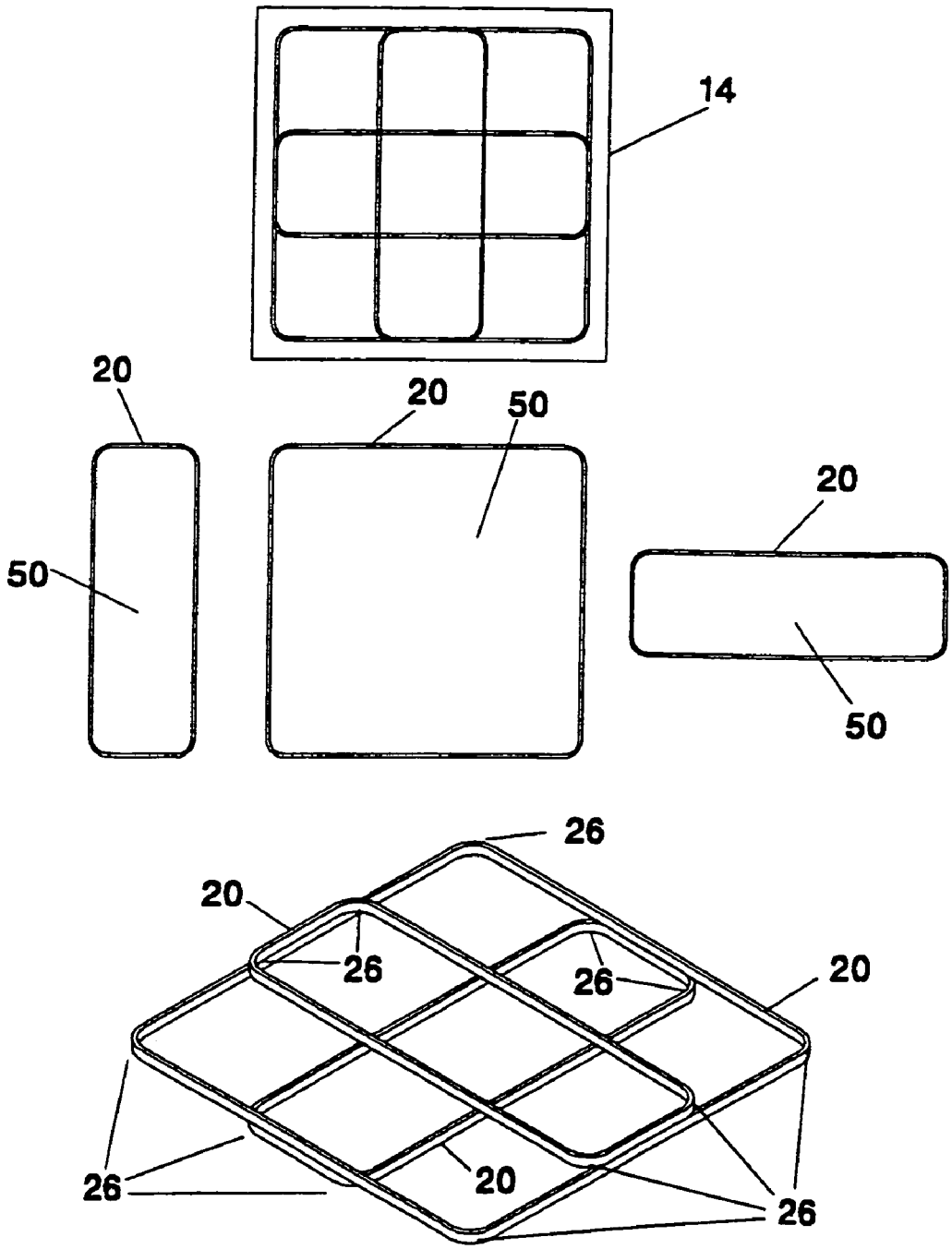
FIG. 4 is top views and a perspective view of a second embodiment of a stirrup according to the present invention.
Figure 5:
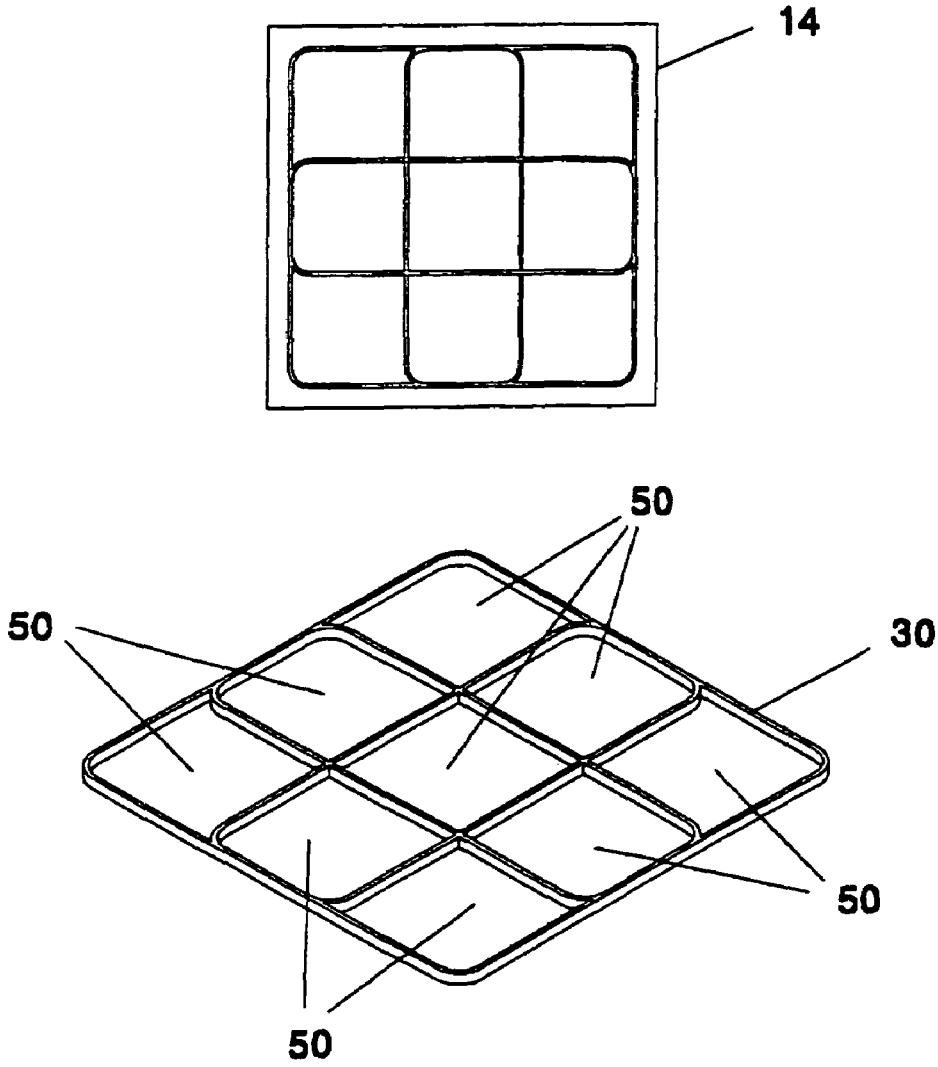
FIG. 5 is a top view and a perspective view of a third embodiment of a stirrup according to the present invention.

FIG. 4 shows a complex stirrup with more than one bearing element, which is the result of the combination of simple rectangular stirrups.

Figure 6:
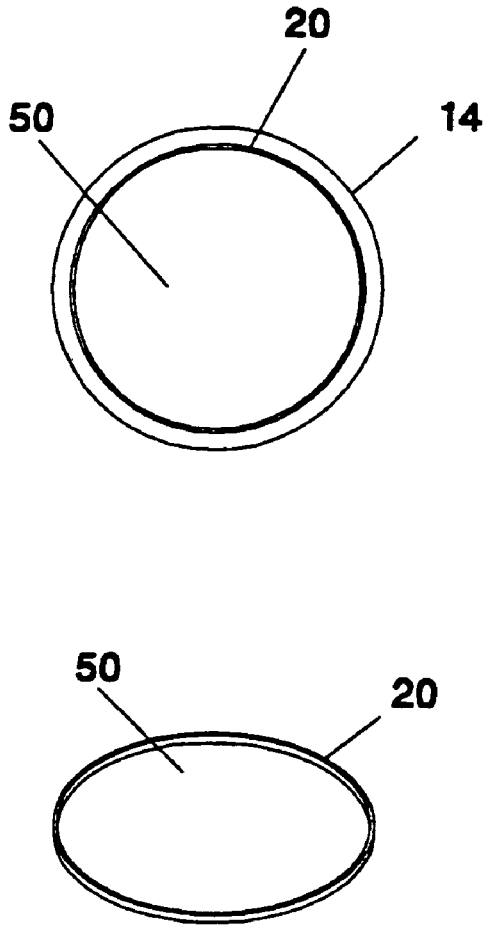
FIG. 6 is a top view and a perspective view of a fourth embodiment of a stirrup according to the present invention.
Figure 9:
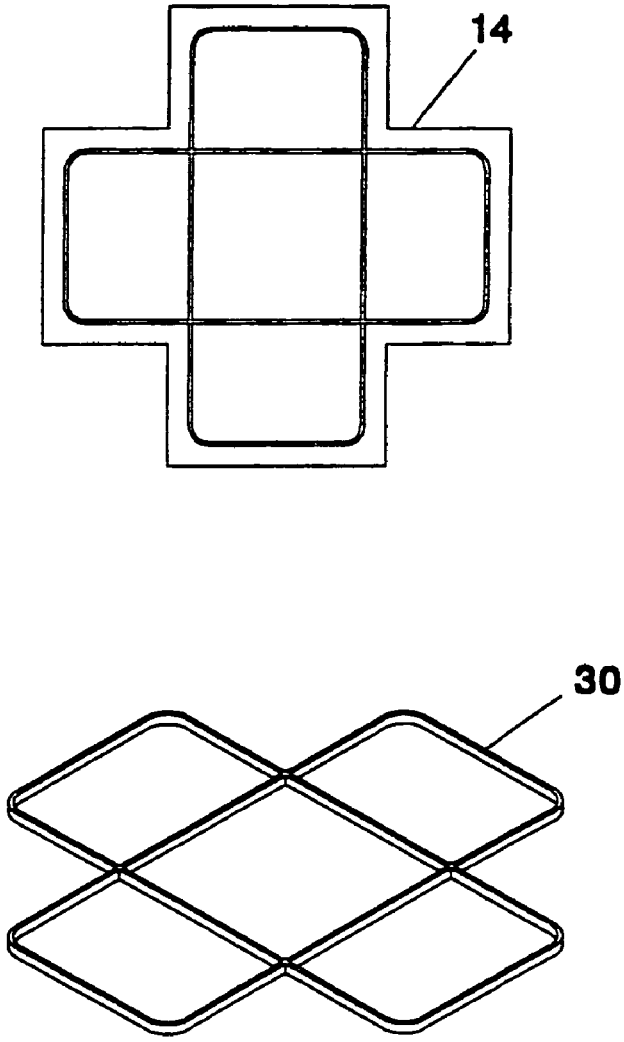
FIG. 9 is a top view and a perspective view of a seventh embodiment of a stirrup according to the present invention.
Figure 10:
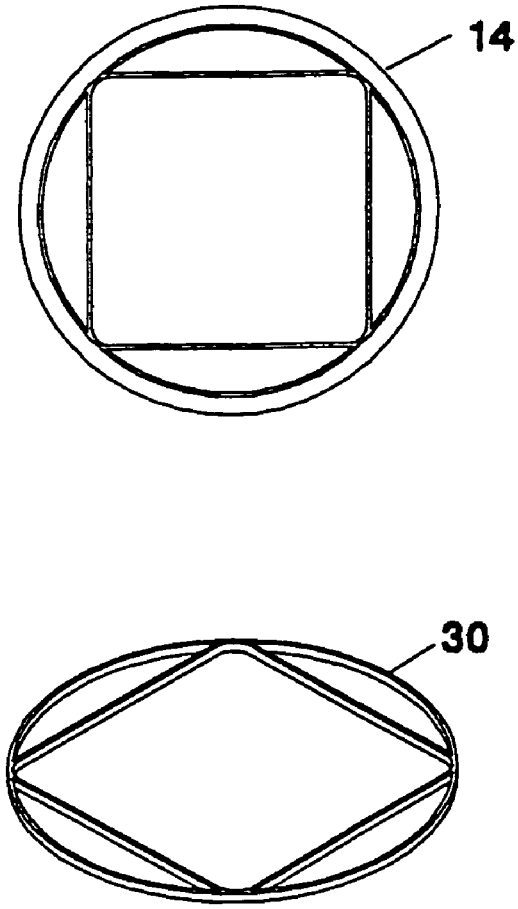
FIG. 10 is a top view and a perspective view of an eighth embodiment of a stirrup according to the present invention.

FIG. 6 shows a cellular stirrup of almost circular shape, in accordance with the invention.

In order on one hand to save time during the assembly of the reinforcement and on the other hand to accommodate material, the simple, rectangular or circular, as well as the complex stirrups, with more than one closed cell, may be cast in factory. Stirrups with a bearing element 30 that consist of more than one cell are shown in FIGS. 5, 7, 8, 9, 10, 11, and 12. Reference sign 26 designates the places, which have been formed optionally to receive the rebars 10. On the contrary the corners 27 do not have the appropriate shaping for receiving the rebars 10.

Figure 13:
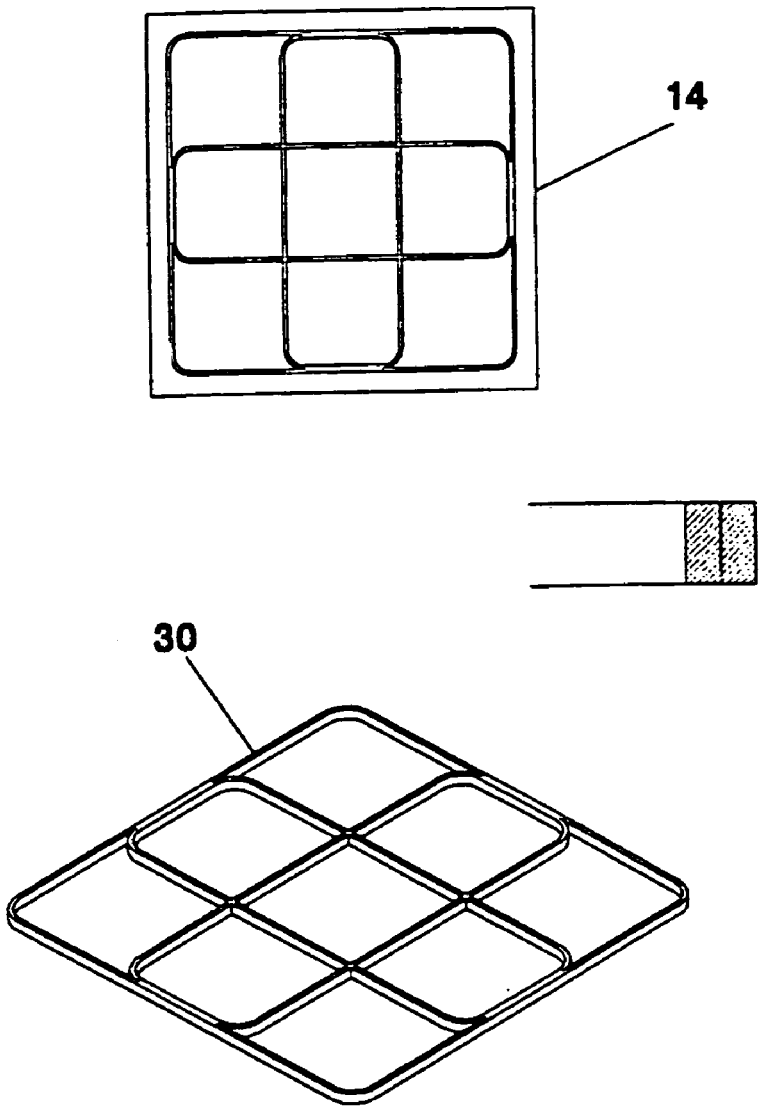
FIG. 13 is a top view and a perspective view of an eleventh embodiment of a stirrup according to the present invention.
Figure 14:
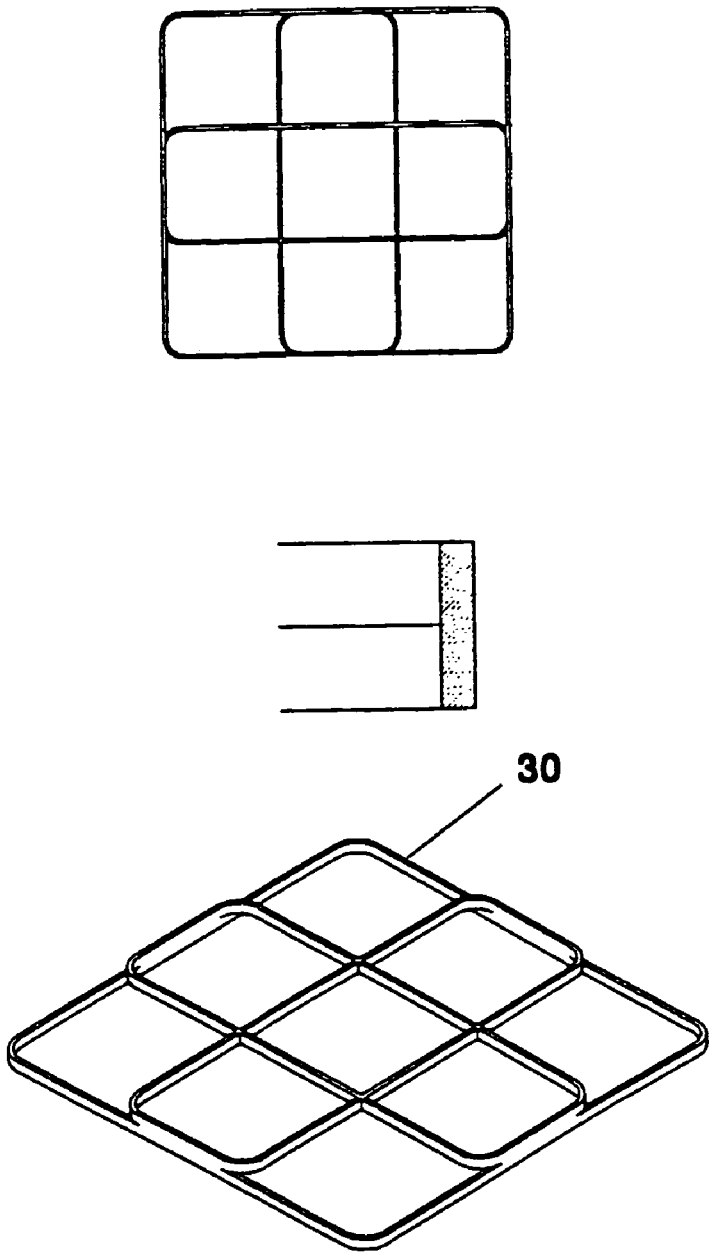
FIG. 14 is a top view and a perspective view of a twelfth embodiment of a stirrup according to the present invention.
Figure 15:
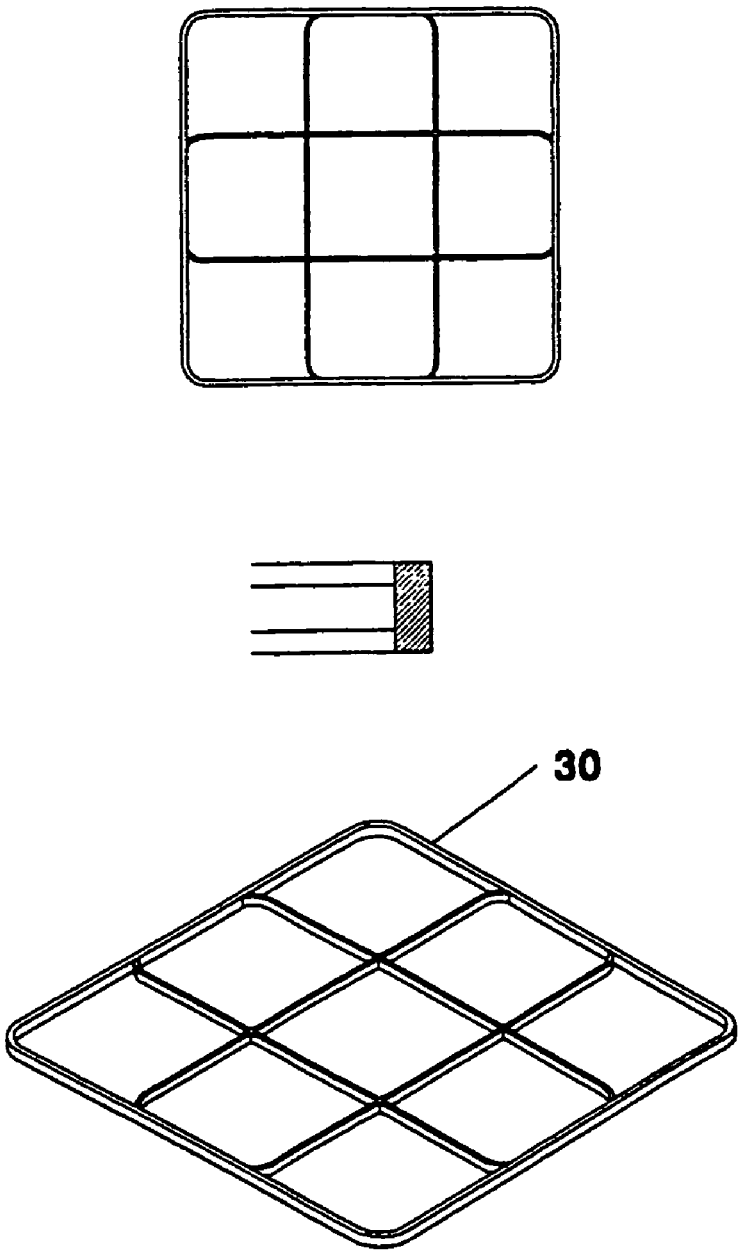
FIG. 15 is a top view and a perspective view of a thirteenth embodiment of a stirrup according to the present invention.

Every part of a complex stirrup or tie has a continuous cross-section, but it may be of various shapes and sizes (FIG. 12). The enlargement of the cross-section may be done in both directions, i.e. either to the width inside the cross-section of the element (see FIG. 13), or to the height upward or downward (see FIG. 14) or simultaneously to the width and height in every direction (see FIG. 15). The cross-section of the load bearing elements may have any shape and need not be rectangular as shown in these figures.

Both forms of load bearing elements, i.e. load bearing elements with one dosed cell and with multiple dosed cells, have continuous cross-section, with no free ends. In this way anchoring of the stirrups is completely avoided. The dosed cellular shape has no discontinuation and gives the stirrups uniform behaviour with no hot spots, i.e. with no points of stress concentration. Thus the stirrups have high ductility and they are able to withstand high seismic loads. Further the high tensile strength along the whole length of the bearing element, renders the use of materials with high tensile properties feasible for their production. Such materials can be loaded with shear forces when used to reinforce columns, beams and other concrete structural members and may be tightened around the rebars to increase the compressive strength and further improve the antiseismic behaviour of the structural members.

For the fixing of the rebars in the cellular stirrups or ties, when they are manufactured of composites, it may be advantageous to incorporate a bipolar wire 71 during the casting at the points of fastening of the rebars (FIG. 16).

An alternative method for the fixing of rebars is the shaping of special places 72 during the manufacturing at the points 26 for the passage and restraining of the rebars 10 (FIG. 17).

For the manufacture of Prefabricated stirrup cages, it may be advantageous to cast some special elements for holes, like the holes 73 of FIG. 18. These holes are provided for flexible wire or rigid bar i.e. steel installation bars. They may be found at the four outer corners of the stirrup or tie (FIG. 18) or at every other position of the stirrup (FIG. 19). The bipolar wire 71 for the fastening of the rebars and holes 73 for the installation bars, may coexist in any of the stirrups and ties described (FIG. 20).

The fixing of the stirrups and ties on the installation may be achieved by any chemical, thermal or mechanical method or even by friction and wedge action. The bars of the installation may be scaled, for example every 5 cm, in order to make the assembly easier. Alternatively in the case of Prefabricated stirrup cages with auxiliary external installation bars located in 73, concave plastic conduits with length equal to the distance between the stirrups i.e. 10 cm may be placed on every installation bar before the placing of the ring and so on.

The cover of the reinforcement with concrete, which is usually achieved with the use of plastic spacers, may be simplified by the simple projections 74 at the perimeter of the stirrup, as it is shown on FIG. 21. These projections may exist on only some of the stirrups, for example every 5 stirrups only, to lower the cost.

The material of the cellular stirrups which was described above may be rigid and self-bearing, as the normal steel, or flexible as well. The general properties and the tightening are the same for both cases and only the fastening at the right places is different and can be achieved in various ways i.e. with elastic stretching.

The cross-section of the bearing element of a cellular stirrup may be of any shape i.e. square, rectangular, cylindrical, ellipsoidal, trapezoidal, e.t.c. and it is preferably solid.

Because of the same functioning of the cellular stirrups with the usual steel stirrups they can be used together for the reinforcement of the structural members while the longitudinal rebars may consist of the same or different material.

The above mentioned stirrups and ties and may be applied in any cross-section of every structural member. These stirrups and ties are placed along the structural members at distances from approximately 4 cm up to approximately 35 cm. The cross-sections sections of the structural members take values from the range approximately 15 cm up to approximately 2 m.

The method for construction of a concrete structural member comprise the following steps: a) constructing of the framework 14, b) providing longitudinal rebars 10, c) attaching the rebars 10 in stirrups or ties, which stirrups or ties have a load-bearing element with an inner periphery to abut to the longitudinal rebars, and whereby the cross-section of the load bearing element carries the axial forces developed when the structural member is loaded, and d) casting of concrete in the framework and covering the longitudinal rebars and stirrups or ties by the concrete. The fixing of the stirrups or ties within the concrete does not transmit the axial forces developed in their cross-section during loading of the structural member to the concrete.

For the application of the method any of the above mentioned stirrups or the prefabricated stirrup cages may be used. The use of prefabricated stirrup cages secures the connection of the rebars with the stirrups and ties, and the direct transfer of the loads applied to the rebars to them, without loading the concrete.

A load-bearing element of reinforced concrete according to the invention consists of longitudinal rebars, stirrups or ties bound to the rebars and concrete which surrounds the bars and the stirrups. The stirrups and ties comprise at least one bearing element for the fixing of the longitudinal rebars, whereby the cross-section of the bearing element carries the axial forces which are developed during the loading of the structural member. According to the invention the stirrups and ties of the structural member are not anchored in the concrete and thus they do not transmit the tensile forces which are created in the cross-section of the bearing elements of the stirrups and ties thereto. Any one of the stirrups described above may be used to construct a load-bearing element in accordance with the invention.

The stirrups or ties of the invention comprises a load bearing element for the fixing of the longitudinal rebars and for the undertaking of the tensile forces which develop during the loading of the structural member. The bearing element consists of at least one cell of dosed shape so that the flow of the tensile stresses developed in the cross-section is dosed and the stresses are not diffused to the concrete. The load-bearing element has a continuous cross-section and thus there are no free ends as in the known stirrups. In this way anchoring of the stirrups or ties is completely avoided. The method for construction of a structural element in accordance with the invention and the structural member itself is built so that the axial tensile forces developed in the cross-section of the stirrup or tie are not diffused from the stirrup or tie.

The invention claimed is:

1. A stirrup or tie for the reinforcement of concrete structural members, comprising at least one load bearing element to receive rebars of the reinforcement, wherein the at least one load bearing element is made from a composite material and a) forms at least one plane cell of closed shape with an inner periphery to receive the rebars of the reinforcement, which are arranged on at least two planes, and b) has a continuous cross-section to carry axial tensile force developed when the structural member is loaded, so that the flow of the tensile stresses developed in the cross-section of the at least one load bearing element is closed and continuous and is not transmitted to the surroundings of the stirrup or tie.

2. The stirrup or tie for the reinforcement of concrete structural members according to claim 1, wherein the at least one load bearing element has a solid cross-section.

3. The stirrup or tie for the reinforcement of concrete structural members according to claim 1, wherein the stirrup or tie does not have any means to anchor the stirrup to the concrete, so that the axial force developed in the cross-section of the at least one load bearing element is not transmitted to the surroundings of the stirrup or tie.

4. The stirrup or tie for the reinforcement of concrete structural members according to claim 1, wherein the stirrup or tie includes more than one load bearing element and that each one of the load bearing elements consists of one cell of closed shape so that the flow of the tensile stresses developed in the cross-section of each one of the load bearing elements is closed and it is not transmitted to the concrete.

5. The stirrup or tie for the reinforcement of concrete structural members according to claim 1, wherein the at least one load bearing element has a curved shape.

6. The stirrup or tie for the reinforcement of concrete structural members according to claim 1, wherein the at least one load bearing element has a rectangular shape.

7. The stirrup or tie for the reinforcement of concrete structural members according to claim 1, wherein the at least one load bearing element includes more than one cell of closed shape so that the flow of the tensile stresses developed in the cross-section of the at least one bearing element is closed and it is not transmitted to the surroundings of the stirrups or tie.

8. The stirrup or tie for the reinforcement of concrete structural members according to claim 1, wherein the inner periphery of the at least one load bearing element has means to receive the rebars.

9. The stirrup or tie for the reinforcement of concrete structural members according to claim 1, wherein the stirrup or tie further includes bipolar wires for fastening the rebars on the at least one load bearing element.

10. The stirrup or tie for the reinforcement of concrete structural members according to claim 1, wherein the stirrup or tie is metallic.

11. The stirrup or tie for the reinforcement of concrete structural members according to claim 1, wherein the at least one load bearing element is cast.

12. The stirrup or tie for the reinforcement of concrete structural members according to claim 1, wherein the cross-section of the at least one load bearing element is variable.

13. The stirrup or tie for the reinforcement of concrete structural members according to claim 1, wherein the cross-section of the at least one load bearing element may carry safely a 100 N tensile load.

14. The stirrup or tie for the reinforcement of concrete structural members according to claim 1, wherein the stirrup or tie further includes bores to receive auxiliary installation bars.

15. The stirrup or tie for the reinforcement of concrete structural members according to claim 1, wherein protrusions are provided along the load bearing element.

16. A reinforcement for concrete structural members, comprising longitudinal rebars and stirrups or ties, including at least one load bearing element made from a composite material and having at least one plane cell of closed and continuous shape and continuous cross-section and connected with the rebars transversely or at an angle.

17. The reinforcement for concrete structural members according to claim 16, wherein the reinforcement is prefabricated.

18. A method for construction of a concrete structural member comprising the following steps:

constructing a framework, providing longitudinal rebars, attaching the rebars to stirrups or ties, which stirrups or ties comprise a load bearing element made from a composite material for receiving the rebars, wherein the load bearing element a) forms at least one plane cell of closed and continuous shape with an inner periphery to receive the rebars which are arranged on at least two planes, and b) has a continuous cross-section to carry axial tensile force developed when the structural member is loaded, so that the flow of the tensile stresses developed in the cross-section of the load bearing element is closed and is not transmitted to the surroundings of the stirrup or tie, and casting of concrete in the framework and covering the longitudinal rebars and the stirrups or ties by the concrete.

19. A concrete structural member comprising longitudinal rebars, stirrups or ties which interact with the rebars, and concrete which surrounds both the rebars and the stirrups or ties, wherein the stirrups or ties comprise a load bearing element made from a composite material for receiving the rebars, and the load bearing element a) forms at least one plane cell of closed and continuous shape with an inner periphery to receive the rebars which are arranged on at least two planes, and b) has a continuous cross-section to carry axial tensile force developed when the structural member is loaded, so that the flow of the tensile stresses developed in the cross-section of the load bearing element is closed and is not transmitted to the surroundings of the stirrup or tie.

* * * * *

UNITED STATES PATENT AND TRADEMARK OFFICE

CERTIFICATE OF CORRECTION

PATENT NO. : 7,421,827 B1
APPLICATION NO. : 09/530745
DATED : September 9, 2008
INVENTOR(S) : Konstantinidis It is certified that error appears in the above-identified patent and that said Letters Patent is hereby corrected as shown below:

Title page, item [56], References Cited, U.S. PATENT DOCUMENTS, add:
-- 5,185,920 11/1991 Aguilo --

Title page, item [56], References Cited, FOREIGN PATENT DOCUMENTS, add:
-- GB 1,086,857 10/1967 --

Title page, item [56], References Cited, OTHER PUBLICATIONS, delete the second publication which is a duplicate reference cited by the Examiner. This reference also contains a typographical error on line 1.
"Factors influecing" should read -- Factors influencing --

Sheet 5 of 22, "Figur 4" should read -- Figure 4 --

Signed and Sealed this

Third Day of February, 2009

John Doll

JOHN DOLL
*Acting Director of the United States Patent and Trademark Office*